US010652677B2

(12) United States Patent
Marxen et al.

(10) Patent No.: US 10,652,677 B2
(45) Date of Patent: May 12, 2020

(54) HEARING ASSISTANCE DEVICE AND METHOD OF FORMING SAME

(71) Applicant: Starkey Laboratories, Inc., Eden Prairie, MN (US)

(72) Inventors: Christopher Marxen, Minnetrista, MN (US); Brian Kaspari, Eagan, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 96 days.

(21) Appl. No.: 15/336,281

(22) Filed: Oct. 27, 2016

(65) Prior Publication Data

US 2017/0127199 A1 May 4, 2017

Related U.S. Application Data

(60) Provisional application No. 62/247,988, filed on Oct. 29, 2015.

(51) Int. Cl.
*H04R 1/10* (2006.01)
*H04R 25/00* (2006.01)

(52) U.S. Cl.
CPC ..... *H04R 25/658* (2013.01); *H04R 25/652* (2013.01); *H04R 2225/021* (2013.01); *H04R 2225/77* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,032,337 | B2 | 10/2011 | Deichmann et al. | |
| 8,175,310 | B2 | 5/2012 | Nielsen et al. | |
| 9,374,650 | B2 | 6/2016 | Bauman | |
| 9,433,373 | B2 | 9/2016 | Burns | |
| 2011/0068502 | A1 | 3/2011 | Basseas | |
| 2011/0077760 | A1 | 3/2011 | Schmidt et al. | |
| 2012/0232857 | A1 | 9/2012 | Fisker et al. | |
| 2013/0051590 | A1* | 2/2013 | Slater | H04R 1/10 381/317 |

(Continued)

FOREIGN PATENT DOCUMENTS

WO WO 2007/090407 A1 8/2007

OTHER PUBLICATIONS

U.S. Appl. No. 62/235,888, filed Oct. 1, 2015, Sacha et al.
U.S. Appl. No. 14/827,837, filed Aug. 17, 2015, Rabel et al.

*Primary Examiner* — Amir H Etesam
(74) *Attorney, Agent, or Firm* — Mueting, Raasch & Gebhardt, P.A.

(57) ABSTRACT

Various embodiments of a hearing assistance device and a method of forming such device are disclosed. The hearing assistance device can provide sound to an ear of a patient. The device includes a housing adapted to be worn on or behind the ear, hearing assistance components enclosed in the housing, and an earmold adapted to be worn in the ear. The device further includes a sound tube adapted to transmit sound from the housing to the earmold, and an earhook adapted to connect the housing to the sound tube. The earmold and the sound tube are printed three dimensionally (3D) as one piece that is custom fit for the patient using a computer-aided design software (CAD) model. Further, a first end of the sound tube is integral with the earmold.

20 Claims, 4 Drawing Sheets

(56) References Cited

U.S. PATENT DOCUMENTS

| | | | | |
|---|---|---|---|---|
| 2014/0120319 | A1* | 5/2014 | Joseph | G01B 11/25 428/172 |
| 2015/0055809 | A1 | 2/2015 | Rasmussen et al. | |
| 2015/0264496 | A1* | 9/2015 | Reber | H04R 25/652 381/328 |
| 2016/0080868 | A1* | 3/2016 | Hensen | H04R 5/04 381/311 |

* cited by examiner

HEARING ASSISTANCE DEVICE AND METHOD OF FORMING SAME

CROSS-REFERENCE TO RELATED APPLICATION

This application claims the benefit of U.S. Provisional Application No. 62/247,988, filed Oct. 29, 2015, the disclosure of which is incorporated by reference herein in its entirety.

TECHNICAL FIELD

This disclosure relates generally to hearing assistance devices and more particularly to an integral earmold and sound tube for hearing assistance devices.

BACKGROUND

Hearing assistance devices, such as hearing aids, can be used to assist patients suffering hearing loss by transmitting amplified sounds to one or both ear canals. In one example, a hearing aid can be worn in and/or around a patient's ear. Hearing aids can be small and of appropriate form-factor to be unobtrusive and comfortable for the patient to wear. A behind-the-ear (BTE) hearing aid can utilize tubing (i.e., a sound tube) to interface an earhook of the behind-the-ear portion with an earmold worn in the patient's ear. Traditional earmold tubing is attached using a secondary process including inserting, via friction fit, a silicone hollow tube through a sound hole formed in the earmold. This traditional tubing tends to age and wear, becoming yellow and brittle. Replacing the tubing can be problematic, as it can be difficult to ensure proper tube direction and length for a particular patient.

SUMMARY

In general, the present disclosure provides various embodiments of a hearing assistance device and a method of forming such device. The hearing assistance device can include an earpiece that includes an earmold adapted to be worn in an ear of a patient, and a sound tube that is adapted to transmit an acoustic output or sound from a housing of the device to the earmold. In one or more embodiments, the earmold and the sound tube can be formed as one piece that is custom fit for the patient such that the sound tube is integral with the earmold.

In one aspect, the present disclosure provides a hearing assistance device to provide sound to an ear of a patient. The device includes a housing adapted to be worn on or behind the ear, hearing assistance components enclosed in the housing, and an earmold adapted to be worn in the ear. The device further includes a sound tube adapted to transmit sound from the housing to the earmold, and an earhook adapted to connect the housing to the sound tube. The earmold and the sound tube are printed three dimensionally (3D) as one piece that is custom fit for the patient using a computer-aided design software (CAD) model. Further, a first end of the sound tube is integral with the earmold.

In another aspect, the present disclosure provides a method of forming a hearing assistance device. The method includes forming a three-dimensional model of an ear cavity of a patient, forming a three-dimensional model of an earmold based upon the three-dimensional model of the ear cavity, and forming a three-dimensional model of a sound tube that is integral with the three dimensional model of the earmold, where the three-dimensional model of the sound tube is aligned with a sound hole of the three-dimensional model of the earmold. The method further includes forming an earmold and a sound tube from the three-dimensional models of the earmold and sound tube, where a first end of the sound tube is integral with the earmold.

In another aspect, the present disclosure provides an earpiece that includes an earmold having a sound hole, a sound tube having a first end that is integral with the earmold such that the sound tube is acoustically connected to the sound hole of the earmold, and an earhook that is integral with a second end of the sound tube.

All headings provided herein are for the convenience of the reader and should not be used to limit the meaning of any text that follows the heading, unless so specified.

The term "comprises" and variations thereof do not have a limiting meaning where the term appears in the description and claims. Such term will be understood to imply the inclusion of a stated step or element or group of steps or elements but not the exclusion of any other step or element or group of steps or elements.

The words "preferred" and "preferably" refer to embodiments of the disclosure that may afford certain benefits, under certain circumstances; however, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

As used herein in connection with a measured quantity, the term "about" refers to that variation in the measured quantity as would be expected by the skilled artisan making the measurement and exercising a level of care commensurate with the objective of the measurement and the precision of the measuring equipment used. Herein, "up to" a number (e.g., up to 50) includes the number (e.g., 50).

Also herein, the recitations of numerical ranges by endpoints include all numbers subsumed within that range as well as the endpoints (e.g., 1 to 5 includes 1, 1.5, 2, 2.75, 3, 3.80, 4, 5, etc.).

These and other aspects of the present disclosure will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Throughout the specification, reference is made to the appended drawings, where like reference numerals designate like elements, and wherein.

DETAILED DESCRIPTION

Figure 1:
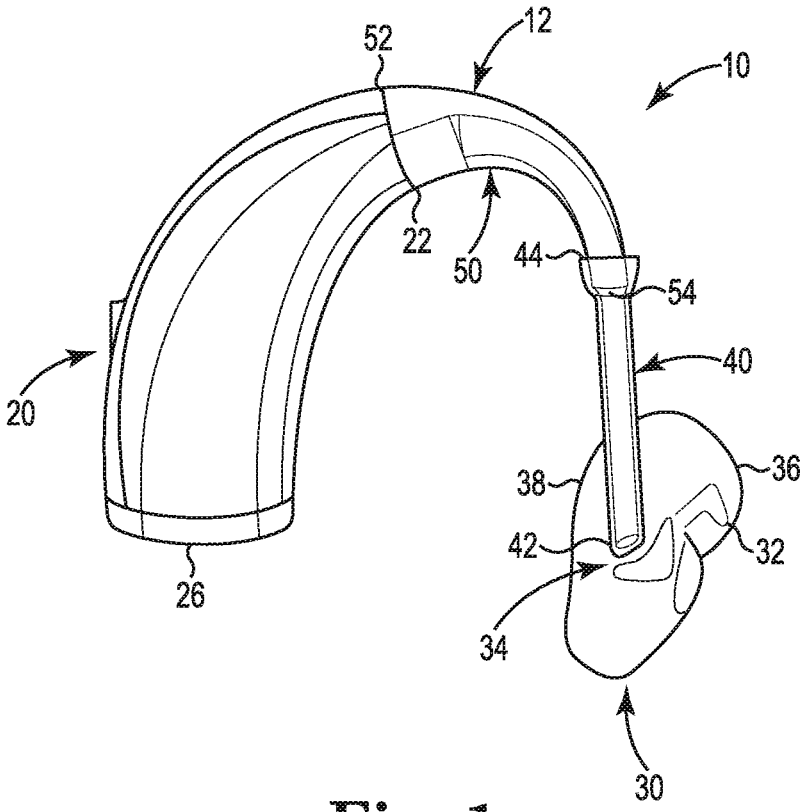
FIG. 1 is a schematic perspective view of one embodiment of a hearing assistance device.

In general, the present disclosure provides various embodiments of a hearing assistance device and a method of forming such device. The hearing assistance device can include an earpiece that includes an earmold adapted to be worn in an ear of a patient, and a sound tube that is adapted to transmit sound from a housing of the device to the earmold. In one or more embodiments, the earmold and the sound tube can be formed as one piece that is custom fit for the patient such that the sound tube is integral with the earmold. As used herein, the term "integral" means two or more components that are made at the same time as a single part such that the two or more components cannot be separated without damaging one or more of the components.

The present disclosure describes various embodiments of hearing assistance devices using the example of hearing aids. Hearing aids are only one type of hearing assistance device. Other hearing assistance devices include, but are not limited to, those in this disclosure. It is understood that their use in the disclosure is intended to demonstrate the present subject matter but not in a limited, exclusive, or exhaustive sense.

Hearing aids can be small and of appropriate form-factor to be unobtrusive and comfortable for the patient to wear. For example, a behind-the-ear (BTE) hearing aid uses tubing to connect an earhook of the behind-the-ear portion (i.e., housing) with an earmold worn in the patient's ear. Traditional earmold tubing is attached using a secondary process including inserting, via friction fit, a hollow silicone tube through a sound hole disposed in the earmold. This traditional tubing tends to age and wear, getting yellow and brittle. Replacing the tubing can be problematic as it is difficult to ensure proper tube direction and length for a particular patient.

The present disclosure provides an earmold and sound tube that, in one or more embodiments, is 3D printed as one piece, i.e., a monolithic unit that includes the earmold and the sound tube. In one or more embodiments, computer-aided design software (CAD) modeling can be used to integrate into standard digital earmold models a sound tube model that interfaces with a BTE earhook, and the complete unit can be formed using, e.g., 3D printing technology. In one or more embodiments, both hard and soft earmold materials can be utilized to form an integral earmold and sound tube. As used herein, the term "soft material" means a material or combination of materials that has a hardness of between Shore A 5 and Shore A 90 as measured in accordance with ASTM D2240. Further, as used herein, the term "hard material" means a material or combination of materials that has a hardness of between Shore D 30 and Shore D 90 as measured in accordance with ASTM D2240.

The tube direction and length of the sound tube that is integral with the earmold can be CAD modeled for each patient. In one or more embodiments, the sound tube can connect directly to the earhook, or a short tube can be connected between the sound tube and the earhook. In one or more embodiments, replacing this short tube can be advantageous as the integral sound tube that can be tailored to the patient does not need to be replaced. In one or more embodiments, the earhook, sound tube, and earmold can be integral, thereby providing a completely integrated system that can be connected, e.g., to a traditional BTE. In one or more embodiments, the integral earmold and sound tube can be produced using high-strength silicone material and can have high tear resistance and flexibility to maintain tube direction and positioning against the head and over the ear of the patient.

The present disclosure can utilize custom 3D CAD modeling, where a sound tube feature is integrated and formed into a custom earmold to provide a one piece or monolithic earpiece having both an earmold and sound tube. This integrated tube design can include both hard material and soft material optional styles. The integrated tube form factor design and configuration can vary, and exemplary designs can include a shorter integrated tube with a traditional sound tube connecting to the BTE earhook; a medium-length integrated tube with a traditional sound tube connecting to the BTE earhook; a full length integrated tube connecting directly to the BTE earhook; or a full system that includes an integral earmold, sound tube, and earhook that can connect directly to the BTE. Other configurations can be used without departing from the scope of the present disclosure.

In one or more embodiments, earmold customization can be created from a digital scan of an impression of an ear cavity of the patient using a point cloud brought into the earmold CAD modeling software. As used herein, the term "ear cavity" means at least a portion of one or both of an ear canal and pinna of the ear of the patient. In one or more embodiments, a standard earmold modeling sequence can be utilized that is based on the impression shape and selected style. In one or more embodiments, the ear cavity of the patient can be digitally scanned to provide a model of the ear cavity. A specific digital sound tube and interface component can be added during the standard modeling process. This additive file can be placed in conjunction and in alignment with a standard sound hole of the earmold. In one or more embodiments, proper direction and placement of the sound tube can ensure positioning and integration to the BTE earhook, and ear identifiers and placement can be based on the helix, crux, and canal direction of the patient. Desired placement of the sound tube can provide a parallel and close fitment against the head of the patient. In one or more embodiments, a completed CAD modeling file can be saved in "stl" file format and provided to a 3D printer. Different 3D printing platforms can be utilized depending upon the material or materials utilized for the earmold. For example, hard resin can be printed layer by layer using stereolithography (SLA) or direct light processing (DLP).

In one or more embodiments, soft silicone can be 3D printed using a thin walled cast methodology, creating a hollow cast with all digital component features. A secondary manual silicone injection process can create the final physical soft earmold and tube. In one or more embodiments, post-processing can include resin removal and curing for hard earmolds. Soft thin walled casts filled with silicone are cured under pressure. After fully curing, the outer casts are cracked and "de-shelled" to uncover the soft earmold. All cast material can then be removed from the integrated sound tube feature.

Benefits of one or more embodiments of the present disclosure can include reduction of manufacturing costs, elimination of the separate production of tubing, elimination of the need for a tubing sub-assembly, simplification of the replacement of tubing in the field, extension of the longevity of earmold tubing, and elimination of the need to change tubing in the field.

The present disclosure is demonstrated for hearing assistance devices, including but not limited to, behind-the-ear (BTE) type hearing assistance devices. It is understood that behind-the-ear type hearing assistance devices can include devices that reside substantially behind the ear or over the ear. Such devices can include hearing assistance devices with receivers associated with the electronics portion of the behind-the-ear device, or hearing assistance devices of the type having receivers in the ear canal of the patient, including but not limited to receiver-in-canal (RIC) or receiver-in-the-ear (RITE) designs. The present disclosure can also be used in hearing assistance devices generally, such as cochlear implant-type hearing devices. The present disclosure can also be used in deep insertion devices having a transducer, such as a receiver or microphone. The present disclosure can be used in devices whether such devices are standard or custom fit and whether they provide an open or an occlusive design. It is understood that other hearing assistance devices not expressly stated herein can be used in conjunction with the present disclosure.

Figure 2:
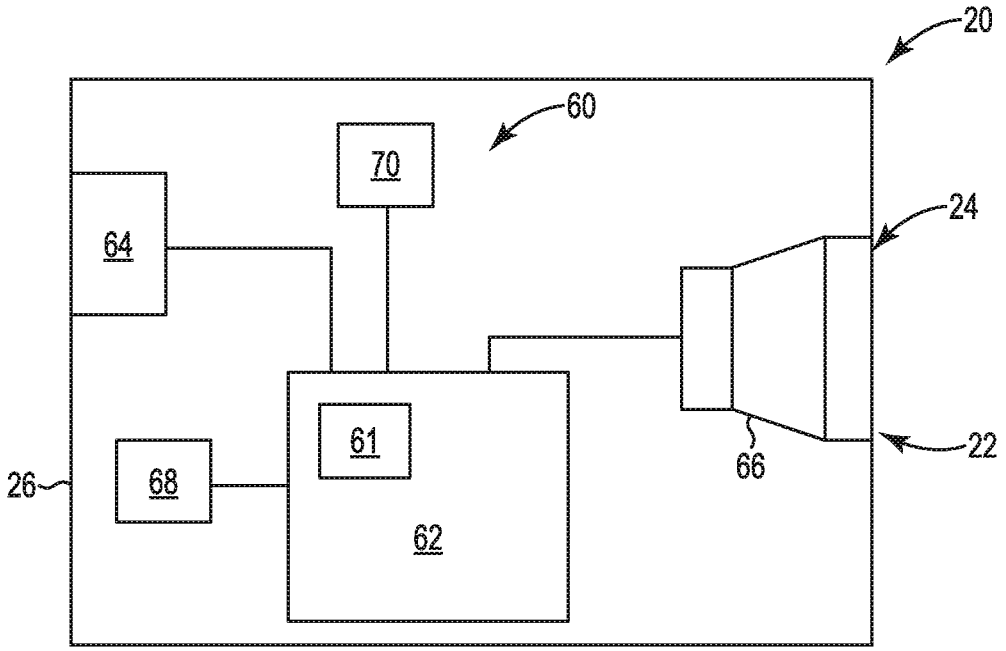
FIG. 2 is a schematic cross-section view of a housing of the hearing assistance device of FIG. 1.

FIGS. 1-2 are various views of one embodiment of a hearing assistance device 10. The device 10 can provide sound to an ear of a patient (not shown). The device 10 includes a housing 20 adapted to be worn on or behind the ear, hearing assistance components 60 enclosed in the housing, and an earmold 30 adapted to be worn in the ear. The device can also include a sound tube 40 adapted to transmit an acoustic output or sound from the housing 20 to the earmold 30, and an earhook 50 adapted to connect the housing to the sound tube. As used herein, the term "acoustic output" means a measure of the intensity, pressure, or power generated by an ultrasonic transducer.

In one or more embodiments, the sound tube 40 can be integral with the earmold 30. Further, the earmold 30, sound tube 40, and earhook 50 can together provide an earpiece 12.

The housing 20 can take any suitable shape or combination of shapes and have any suitable dimensions. In one or more embodiments, the housing 20 can take a shape that can conform to at least a portion of the ear of the patient. Further, the housing 20 can include any suitable material or combination of materials, e.g., silicone, urethane, acrylates, flexible epoxy, acrylated urethane, and combinations thereof.

Any suitable hearing assistance components can be enclosed in the housing 20. For example, FIG. 2 is a schematic cross-section view of the housing 20 of device 10 of FIG. 1. Hearing assistance components 60 are enclosed in the housing 20 and can include any suitable device or devices, e.g., integrated circuits, power sources, microphones, receivers, etc. For example, in one or more embodiments, the components 60 can include a processor 62, a microphone 64, a receiver 66 (e.g., speaker), a power source 68, and an antenna 70. The microphone 64, receiver 66, power source 68, and antenna 70 can be electrically connected to the processor 62 using any suitable technique or combination of techniques.

Any suitable processor 62 can be utilized with the hearing assistance device 10. For example, the processor 62 can be adapted to employ programmable gains to adjust the hearing assistance device output to a patient's particular hearing impairment. The processor 62 can be a digital signal processor (DSP), microprocessor, microcontroller, other digital logic, or combinations thereof. The processing can be done by a single processor, or can be distributed over different devices. The processing of signals referenced in this disclosure can be performed using the processor 62 or over different devices.

In one or more embodiments, the processor 62 is adapted to perform instructions stored in one or more memories 61. Various types of memory can be used, including volatile and nonvolatile forms of memory. In one or more embodiments, the processor 62 or other processing devices execute instructions to perform a number of signal processing tasks. Such embodiments can include analog components in communication with the processor 62 to perform signal processing tasks, such as sound reception by the microphone 64, or playing of sound using the receiver 66.

The hearing assistance components 60 can also include the microphone 64 that is electrically connected to the processor 62. Although one microphone 64 is depicted, the components 60 can include any suitable number of microphones. Further, the microphone 64 can be disposed in any suitable location within the housing 20. For example, in one or more embodiments, a port or opening can be formed in the housing 20, and the microphone 64 can be disposed adjacent the port to receive audio information from the patient's environment.

Any suitable microphone 64 can be utilized. In one or more embodiments, the microphone 64 can be selected to detect one or more audio signals and convert such signals to an electrical signal that is provided to the processor. Although not shown, the processor 62 can include an analog-to-digital convertor that converts the electrical signal from the microphone 64 to a digital signal.

Electrically connected to the processor 62 is the receiver 66. Any suitable receiver can be utilized. In one or more embodiments, the receiver 66 can be adapted to convert an electrical signal from the processor 62 to an acoustic output or sound that can be transmitted from the housing 60 to the earmold 30 and provided to the patient. In one or more embodiments, the receiver 66 can be disposed adjacent an opening 24 disposed in a first end 22 of the housing 20. As used herein, the term "adjacent the opening" means that the receiver 66 is disposed closer to the opening 24 disposed in the first end 22 than to a second end 26 of the housing 20.

The power source 68 is electrically connected to the processor 62 and is adapted to provide electrical energy to the processor and one or more of the other hearing assistance components 60. The power source 68 can include any suitable power source or power sources, e.g., a battery. In one or more embodiments, the power source 68 can include a rechargeable battery. In one or more embodiments, the components 60 can include two or more power sources 68.

The components 60 can also include the optional antenna 70. Any suitable antenna or combination of antennas can be utilized. In one or more embodiments, the antenna 70 can include one or more antennas having any suitable configuration. For example, antenna configurations can vary and can be included within the housing 20 or be external to the housing. Further, the antenna 70 can be compatible with any suitable protocol or combination of protocols. In one or more embodiments, the components 60 can also include a transmitter that transmits electromagnetic signals and a radio-frequency receiver that receives electromagnetic signals using any suitable protocol or combination of protocols.

Returning to FIG. 1, the earmold 30 can include any suitable earmold and take any suitable shape or combination of shapes. In one or more embodiments, the earmold 30 includes a body 32 and a sound hole 34 disposed in the body. The sound hole 34 can be disposed in any suitable location in the body 32 of the earmold 30. The sound hole 34 can be disposed in an upper portion 38 of the body 32 and extend through the body and to an opening (not shown) at a first end 36 of the body. The sound hole 34 can be adapted to transmit sound from the sound tube 40 through the body 32 of the earmold 30 such that the sound exits the opening at the first end 36 of the body and is, therefore, transmitted to the patient.

The body 32 of the earmold 30 can take any suitable shape or combination of shapes. In one or more embodiments, the body 32 takes a shape that is compatible with a portion or portions of the ear cavity of the patient. For example, the first end 36 of the body 32 can be adapted to be inserted into the ear canal of the patient.

The earmold 30 can include any suitable material or combination of materials, e.g., silicone, urethane, acrylates, flexible epoxy, acrylated urethane, and combinations thereof.

Further, the earmold 30 can be manufactured using any suitable technique or combination of techniques as is further described herein.

Connected to the earmold 30 is the sound tube 40. The sound tube 40 can be adapted to transmit sound from the housing 20 to the earmold 30. For example, in one or more embodiments, sound can be provided by the receiver 66 and directed through the sound tube 40 to the earmold 30. Such acoustic output can then be directed by the earmold 30 through the sound hole 34 such that the acoustic output is directed through the opening at the first end 36 of the body 32 of the earmold and to the patient.

The sound tube 40 can take any suitable shape or combination of shapes and have any suitable dimensions. In one or more embodiments, the sound tube 40 has a substantially circular cross-section along a length of the sound tube. In one or more embodiments, the cross-section of the sound tube 40 is constant in a direction along the length of the sound tube. Further, in one or more embodiments, the cross-section of the sound tube 40 varies in the direction along the length. Further, an inner diameter of the sound tube 40 can have any suitable dimensions. In one or more embodiments, the inner diameter of the sound tube 40 can be equal to at least 0.5 mm and no greater than 5 mm. In one or more embodiments, the sound tube 40 can have any suitable length. In one or more embodiments, the length of the sound tube 40 is at least 1 mm and no greater than 100 mm.

The sound tube 40 can take any suitable shape or combination of shapes. In one or more embodiments, the sound tube 40 can take a shape that is tailored to follow the anatomy of the patient's ear from the earmold 30 that is inserted at least partially within the inner canal of the patient, around a front edge of the pinna of the patient's ear, and to the earhook 50 of the device 10. In one or more embodiments, one or both of the shape and dimension of the sound tube 40 can be tailored to a specific patient's anatomy. In one or more embodiments, the sound tube 40 can be integral with the earhook 50.

The sound tube 40 can include any suitable material or materials, e.g., the same materials utilized for the earmold 30. In one or more embodiments, the sound tube 40 can include a material or materials that are different from those of the earmold 30.

The sound tube 40 can be connected to the earmold 30 using any suitable technique or combination of techniques. In one or more embodiments, a first end 42 of the sound tube 40 is connected to the sound hole 34 of the earmold 30 by inserting the first end into the sound hole. In one or more embodiments as is further described herein, the sound tube 40 is integral with the earmold 30 such that the first end 42 of the sound tube is aligned with and acoustically connected to the sound hole 34 of the earmold. As used herein, the term "acoustically connected" means that two or more elements or components are connected such that acoustical information (e.g., acoustic output or sound) can be transmitted between the two or more elements or components. For example, the sound tube 40 is integral with the earmold 30 such that sound can be transmitted between the sound tube and earmold.

In one or more embodiments, the sound tube 40 can be directly connected to the housing 20 such that the sound tube acoustically connects the housing to the earmold 30. In one or more embodiments, the device 10 can include the earhook 50 that is adapted to connect the housing 20 to the sound tube 40. Any suitable earhook 50 can be utilized with the device 10. Further, the earhook 50 can have any suitable dimensions and take any suitable shape or combination of shapes. In one or more embodiments, the earhook 50 takes a curved shape such that the earhook follows the forward or front edge of the pinna of the patient's year.

The earhook 50 can include any suitable material or materials, e.g., the same materials utilized for the earmold 30. In one or more embodiments, the earhook 50 can include a material or materials that are different from the materials utilized for the earmold 30. Further, for example, the earhook 50 can include a material or materials that are the same as or different from the materials utilized for the sound tube 40.

The earhook 50 can be connected to the sound tube 40 using any suitable technique or combination of techniques. For example, in one or more embodiments, a second end 54 of the earhook 50 is connected to a second end 44 of the sound tube 40 using any suitable technique or combination of techniques. In one or more embodiments, the second end 54 of the earhook 50 is friction fit either over or within the second end 44 of the sound tube 40.

Figure 5:
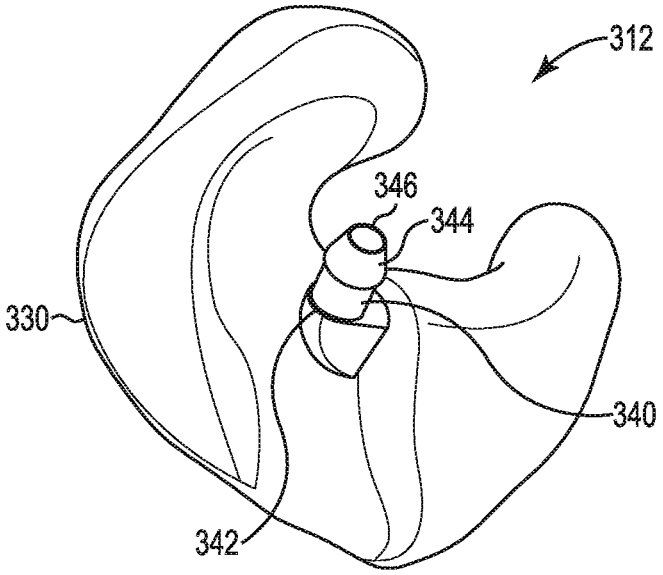
FIG. 5 is a schematic perspective view of another embodiment of an earpiece that can be utilized with the hearing assistance device of FIG. 1.

In one or more embodiments, an adapter for connecting a sound tube to an earmold can be integrally formed with the earmold. For example, FIG. 5 is a schematic perspective view of another embodiment of an earpiece. 312. All of the design considerations and possibilities regarding the earpiece 12 of FIG. 1 apply equally to the earpiece 312 of FIG. 5. The earpiece 312 includes an earmold 330 and an adapter 340 that is integral with the earmold 330. The adapter 340 includes a first end 342 that is integral with the earmold 330 and a second end 344. The adapter 340 includes a connector 346 that is integral with the second end 344 of the adapter. The earpiece 312 can also include a sound tube (not shown for sake of clarity) that can be connected to the second end 344 of the adapter 340. The adapter 340 can include any suitable connector 346. In the embodiment illustrated in FIG. 5, the adapter 340 includes a nipple connector 346 that is adapted to be inserted into an end of the sound tube. The connector 346 can, therefore, have a diameter that is greater than an inner diameter of the sound tube such that the connector is friction-fit within the sound tube and retained therein.

The earhook 50 can be connected to the housing 20 using any suitable technique or combination of techniques. In one or more embodiments, the earhook 50 can include one or more threaded grooves disposed on an inner surface of the first end 52 of the earhook that can be threaded onto threaded grooves formed on the first end 22 of the housing 20.

The device 10 can also include an extension tube (not shown) that connects the sound tube 40 to the earhook 50.

Any suitable extension tube can be utilized. In one or more embodiments, the extension tube acoustically connects the sound tube 40 to the earhook 50.

The earmold 30, sound tube 40, and earhook 50 can, in one or more embodiments, provide the earpiece 12. As mentioned herein, two or more of the earmold 30, sound tube 40, and earhook 50 can be integral. For example, in one or more embodiments, the earhook 50 is integral with the sound tube 40, e.g., the second end 54 of the earhook is integral with the second end 44 of the sound tube. Further, in one or more embodiments, the sound tube 40 can be integral with the earmold 30, e.g., the first end 42 of the sound tube can be integral with the earmold.

Figure 3:
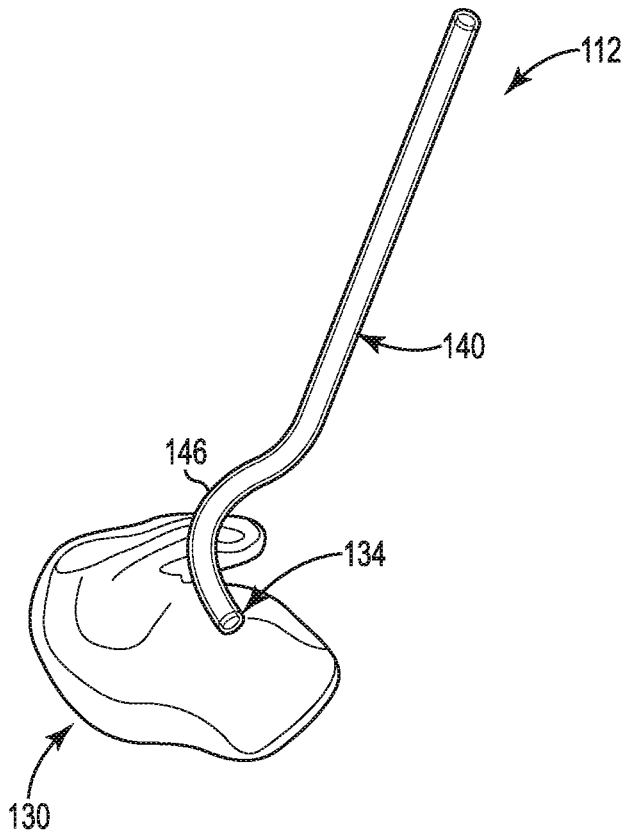
FIG. 3 is a schematic perspective view of one embodiment of an earpiece that can be utilized with the hearing assistance device of FIG. 1.

As mentioned herein, the sound tube 40 of the earpiece 12 can have any suitable length and take any suitable shape or combination of shapes. For example, FIG. 3 is a schematic perspective view of one embodiment of an earpiece 112 that can be utilized with a hearing assistance device (e.g., hearing assistance device 10 of FIGS. 1-2). All of the design considerations and possibilities regarding the earpiece 12 of FIG. 1 apply equally to the earpiece 112 of FIG. 3. The earpiece 112 includes an earmold 130 that includes a sound hole 134. The earpiece 112 also includes a sound tube 140 that is integral with the earmold 130 such that the sound tube is acoustically connected to the sound hole 134 of the earmold. The earpiece 112 can also include an earhook (e.g., earhook 50 of FIG. 1) that is connected to or integral with the sound tube 140. Any suitable technique or combination of techniques can be utilized to form the earpiece 112 as is further described herein.

The sound tube 140 can have any suitable length. As shown in FIG. 3, the sound tube 140 has an extended length that can be trimmed to fit the anatomy of a particular patient. The sound tube 140 also includes a curve or bend 146 that is adapted to direct the sound tube around an outer surface of the pinna of the patient's ear and to the housing of the hearing assistance device disposed at least partially behind the patient's ear.

Returning to FIGS. 1-2, the hearing assistance device 10 can include an optional coating disposed on one or more of the housing 20, earmold 30, sound tube 40, and earhook 50. Further, the coating can include any suitable material or materials.

In one or more embodiments, the coating can provide various desired properties. For example, the coating can include a hydrophobic, hydrophilic, oleophobic, or oleophilic material. In one or more embodiments, the optional coating can include a textured coating to provide the patient with one or more gripping surfaces such that the patient can more easily grasp a portion or portions of the earpiece 12 and dispose the earmold 30 within the ear cavity.

Figure 4:
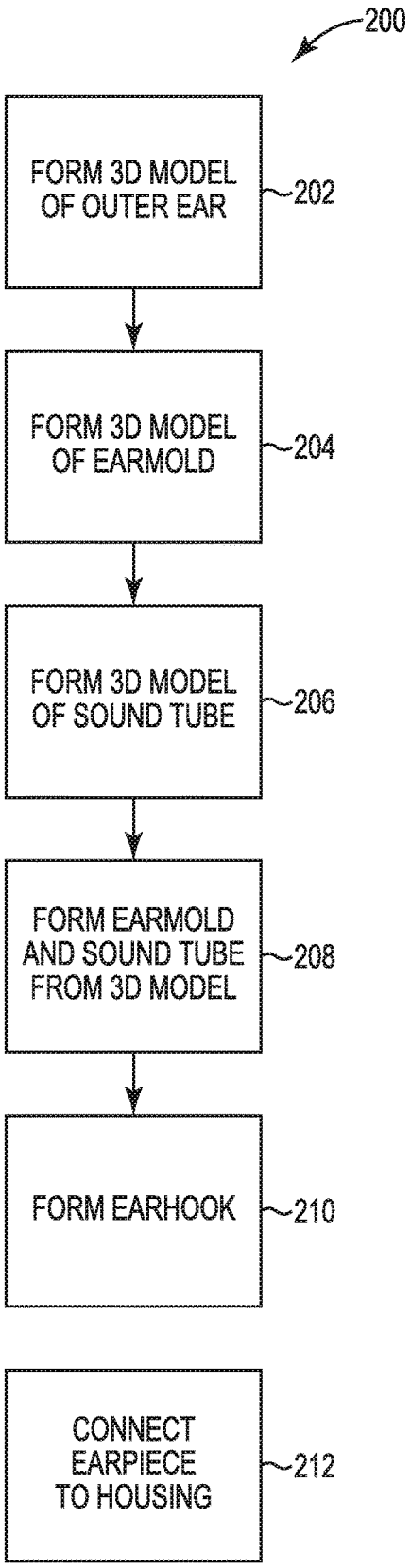
FIG. 4 is a diagram of one embodiment of a method of forming a hearing assistance device.

The device 10 of FIGS. 1-2 can be manufactured using any suitable technique or combination of techniques. For example, FIG. 4 is a schematic diagram of one embodiment of a method 200 of forming the hearing assistance device 10. While the method 200 is described in reference to the device 10 of FIGS. 1-2, such method can be utilized to form any suitable hearing assistance device.

The method 200 includes forming a three-dimensional model of an ear cavity of the patient at 202. In one or more embodiments, the ear cavity can include any suitable portion of the ear canal, e.g., the entire ear canal. Similarly, the ear cavity can include any suitable portion of the pinna. Any suitable technique or combination of techniques can be utilized to form the three-dimensional model of the ear cavity of the patient. In one or more embodiments, a mold of the ear cavity can be taken using any suitable technique or combination of techniques. Such mold can then be scanned using any suitable technique or combination of techniques to provide a digital representation of the mold.

In one or more embodiments, the ear cavity of the patient can be scanned using any suitable technique or combination of techniques to provide a three-dimensional digital representation of the ear cavity without the need for a physical mold of the ear cavity.

At 204, a three-dimensional model of the earmold 30 based upon the three-dimensional model of the ear cavity of the patient can be formed. Any suitable technique or combination of techniques can be utilized to form the three-dimensional model of the earmold 30.

A three-dimensional model of the sound tube 40 can be formed using any suitable technique or combination of techniques at 206. In one or more embodiments, the three-dimensional model of the sound tube 40 can be added to the three-dimensional model of the earmold 30 such that that the sound tube model and the earmold model are integral. In one or more embodiments, the three-dimensional model of the sound tube 40 is aligned with the sound hole 34 of the three-dimensional model of the earmold 30.

At 208, the earmold 30 and the sound tube 40 can be formed from the three-dimensional models of the earmold and sound tube using any suitable technique or combination of techniques, e.g., stereolithography (SLA), fused deposition modeling (FDM), selective laser sintering (SLS), selective laser melting (SLM), electronic beam melting (EBM), laminated object manufacturing (LOM), etc.

In one or more embodiments, the first end 42 of the sound tube 40 is integral with the earmold 30. In one or more embodiments, the integral earmold 30 and sound tube 40 can be formed by printing the earmold and the sound tube using any suitable printing techniques. In one or more embodiments, the earmold 30 and the sound tube 40 can be printed utilizing 3D printing. 3D printing of the earmold 30 and sound tube 40 can include stereo lithographically printing the earmold and the sound tube. In one or more embodiments, the earmold 30 and the sound tube 40 can be 3D printed by utilizing direct light processing.

The earmold 30 and sound tube 40 can be 3D printed using any suitable material or combination of materials. In one or more embodiments, the same material or materials are utilized to print the earmold 30 and the sound tube 40. In one or more embodiments, the earmold 30 can include one or more materials that are different from the one or more materials included in the sound tube 40. In one or more embodiments, each of the earmold 30 and the sound tube 40 can include a hard material or materials. In such embodiments, 3D printing can be performed using a hard resin and stereolithography.

Further, in one or more embodiments, each of the earmold 30 and sound tube 40 can include a soft material or materials. The integrated earmold 30 and sound tube 40 can be formed by 3D printing utilizing a thin-walled cast process. In one or more embodiments, a secondary process can inject a high strength silicone material into a cast that is formed by 3D printing from the 3D model. The silicone material can then be cured under pressure, and the cast can be cracked and removed.

Further, in one or more embodiments, the earmold 30 can include a hard material and the sound tube 40 can include a soft material. In such embodiments, a hard earmold and a soft sound tube can be formed utilizing two-material 3D printing or a hybrid of hard resin earmold and cast printed tube and integration section.

In general, the earmold 30 can be 3D printed with a first composition, and the sound tube 40 can be 3D printed onto the earmold (or vice versa) with a second composition. In one or more embodiments, the first composition is the same as the second composition. In one or more embodiments, the first composition is different from the second composition.

The first and second compositions can have any desired characteristics, e.g., hardness, opacity, ductility, etc. For example, in one or more embodiments, a hardness value of the first composition is equal to, greater than, or less than a hardness value of the second composition.

In one or more embodiments, the earmold 30 and sound tube 40 can be formed by printing a hollow cast that includes an earmold portion and a sound tube portion integral with the earmold portion. A composition can be disposed within the hollow cast. Any suitable composition can be disposed within the cast, e.g., silicone. The composition can be cured using any suitable technique or combination of techniques to form the earmold and integral sound tube. The hollow cast can be removed from the earmold 30 and sound tube 40 utilizing any suitable technique or combination of techniques.

At 210 the earhook 50 can be formed using any suitable technique or combination of techniques. In one or more embodiments, the earhook 50 can be formed such that it is integral with the sound tube 40, e.g., the second end 54 of the earhook 50 can be integral with the second end 44 of the sound tube. Optional threaded grooves can be formed at the first end 52 of the earhook 50 utilizing any suitable technique, e.g., the grooves can be printed when the earhook is formed.

One or more of the earmold 30, sound tube 40, and earhook 50 can be trimmed or shaped after the earpiece 12 has been formed to provide a desired final shape and length. In one or more embodiments, one or more of the earmold 30, sound tube 40, and earhook 50 can be bent into a final configuration for use. Further, the optional coating can be disposed on one or more of the housing 20, earmold 30, sound tube 40, and earhook 50 using any technique or combination of techniques either prior to or after the earpiece 12 has been connected to the housing.

The completed earpiece 12 can be connected to the housing 20 by connecting the first end 52 of the earhook 50 to the first end 22 of the housing 20 of the device 10 using any suitable technique or combination of techniques.

All references and publications cited herein are expressly incorporated herein by reference in their entirety into this disclosure, except to the extent they may directly contradict this disclosure. Illustrative embodiments of this disclosure are discussed and reference has been made to possible variations within the scope of this disclosure. These and other variations and modifications in the disclosure will be apparent to those skilled in the art without departing from the scope of the disclosure, and it should be understood that this disclosure is not limited to the illustrative embodiments set forth herein. Accordingly, the disclosure is to be limited only by the claims provided below.

What is claimed is:

1. A hearing assistance device to provide sound to an ear of a patient, the device comprising:

a housing adapted to be worn on or behind the ear;

hearing assistance components enclosed in the housing;

an earmold adapted to be worn in the ear;

a sound tube adapted to transmit sound from the housing to the earmold, wherein the sound tube comprises an inner diameter that is equal to at least 0.5 mm and no greater than 5 mm; and an earhook adapted to connect the housing to the sound tube;

wherein the earmold and the sound tube are printed three dimensionally (3D) as one piece that is custom fit for the patient using a computer-aided design software (CAD) model, wherein a first end of the sound tube is integral with the earmold.

2. The device of claim 1, wherein the earmold and the sound tube comprise silicone.

3. The device of claim 1, further comprising a coating disposed on the earmold and the sound tube.

4. The device of claim 1, wherein the earhook is integral with a second end of the sound tube.

5. The device of claim 1, further comprising an extension tube connecting the sound tube to the earhook.

6. The device of claim 1, wherein the hearing assistance components comprise at least one of a processor, a microphone, a receiver, a power source, and an antenna.

7. The device of claim 1, wherein the earhook is integral with the sound tube.

8. A method of forming a hearing assistance device, comprising:

forming a three-dimensional model of an ear cavity of a patient;

forming a three-dimensional model of an earmold based upon the three-dimensional model of the ear cavity;

forming a three-dimensional model of a sound tube that is integral with the three dimensional model of the earmold, wherein the three-dimensional model of the sound tube is aligned with a sound hole of the three-dimensional model of the earmold; and 3D printing an earmold and a sound tube from the three-dimensional models of the earmold and sound tube, wherein a first end of the sound tube is integral with the earmold, wherein the sound tube comprises an inner diameter that is equal to at least 0.5 mm and no greater than 5 mm.

9. The method of claim 8, wherein 3D printing the earmold and the sound tube comprises stereolithographically printing the earmold and the sound tube.

10. The method of claim 8, wherein 3D printing the earmold and the sound tube comprises printing the earmold and the sound tube utilizing direct light processing.

11. The method of claim 8, wherein 3D printing the earmold and the sound tube comprises:

3D printing the earmold with a first composition; and 3D printing the sound tube onto the earmold with a second composition.

12. The method of claim 11, wherein a hardness value of the first composition is greater than a hardness value of the second composition.

13. The method of claim 8, wherein 3D printing the earmold and the sound tube comprises:

printing a hollow cast that comprises an earmold portion and a sound tube portion integral with the earmold portion;

disposing a composition within the hollow cast;

curing the composition to form the earmold and the sound tube; and removing the hollow cast from the earmold and the sound tube.

14. The method of claim 8, further comprising forming an earhook comprising a first end and a second end, wherein the second end of the earhook is integral with a second end of the sound tube.

15. The method of claim 14, further comprising connecting the first end of the earhook to a housing of a hearing assistance device.

16. The method of claim 14, wherein forming the earhook comprises:

forming a three-dimensional model of the earhook that is integral with the three-dimensional model of the sound tube; and forming the earhook from the three-dimensional model of the earhook.

17. An earpiece comprising:

an earmold comprising a sound hole;

a sound tube comprising an inner diameter and a first end that is integral with the earmold such that the sound tube is acoustically connected to the sound hole of the earmold; and an earhook that is integral with a second end of the sound tube;

wherein the earmold, sound tube, and earhook are printed three dimensionally (3D) as one piece that is custom fit for the patient using a computer-aided design software (CAD) model.

18. The earpiece of claim 17, wherein the earmold, sound tube, and earhook comprise silicone.

19. The earpiece of claim 17, wherein the sound tube comprises an inner diameter that is equal to at least 0.5 mm and no greater than 5 mm.

20. The earpiece of claim 17, wherein the sound tube and the earhook comprise a material that is different from a material of the earmold.

* * * * *